United States Patent [19]

Pringle et al.

[11] Patent Number: 4,531,581

[45] Date of Patent: Jul. 30, 1985

[54] PISTON ACTUATED HIGH TEMPERATURE WELL PACKER

[75] Inventors: Ronald E. Pringle, Houston; Arthur J. Morris, Magnolia, both of Tex.

[73] Assignee: Camco, Incorporated, Houston, Tex.

[21] Appl. No.: 587,477

[22] Filed: Mar. 8, 1984

[51] Int. Cl.[3] ..... E21B 33/128

[52] U.S. Cl. ..... 166/120; 92/246

[58] Field of Search ..... 166/120, 212, 118, 387; 277/125, 117, 116.2, 236; 92/192, 246

[56] References Cited

U.S. PATENT DOCUMENTS

| | | | |
|---|---|---|---|
| 1,616,310 | 2/1927 | Esnault-Pelterie | 92/246 |
| 2,121,002 | 6/1938 | Baker | 166/120 |
| 2,815,080 | 12/1957 | Long | 166/120 |
| 2,862,775 | 12/1958 | Kupiec | 92/246 |
| 3,049,370 | 8/1962 | Bertrand | 92/246 |
| 3,603,388 | 9/1971 | Current et al. | 166/120 |
| 3,994,208 | 11/1976 | Boyer | 92/246 |
| 4,059,150 | 11/1977 | Manderscheid | 166/120 |
| 4,127,168 | 11/1978 | Hanson et al. | 277/236 |
| 4,363,465 | 12/1982 | Morrill | 277/125 X |
| 4,385,664 | 5/1983 | Hutchison | 166/120 X |
| 4,433,726 | 2/1984 | Preston, Jr. et al. | 166/118 |

FOREIGN PATENT DOCUMENTS

| | | | |
|---|---|---|---|
| 709306 | 5/1954 | United Kingdom | 166/120 |

*Primary Examiner*—James A. Leppink
*Assistant Examiner*—Hoang C. Dang
*Attorney, Agent, or Firm*—Fulbright & Jaworski

[57] ABSTRACT

A well packer for use in a well bore having initially retracted packing seal and slip means which are actuated by hydraulic pistons, the improvement in various seals which allow the packer to be used in high temperature environments. The pistons are ring shaped with cup-shaped sealing surfaces extending towards a hydraulic supply port for sealing by hydraulic fluid. Spacers are provided between the pistons for preventing damage to the piston seals. First and second abutments are provided adjacent one end of the seal packer with a metal seal ring between the abutments and coacting wedge surfaces are provided on the metal seal and each of the abutments for sealing against both abutments and wedging the seal inward for sealing. Metal static seals are provided in the packer which are compressed by threads for providing high temperature seals.

3 Claims, 4 Drawing Figures

PISTON ACTUATED HIGH TEMPERATURE WELL PACKER

BACKGROUND OF THE INVENTION

It is well known to utilize well packers for sealing in a well conduit in which the packer seal and the packer slips are actuated by hydraulic pistons as shown in U.S. Pat. No. 3,603,388 issued Sept. 7, 1971. Typically, piston actuated well packers utilize various elastomer seals in the pistons and also utilize various elastomer seals in other parts of the packer.

However, in high temperature applications for a well packer, such as in steam injection wells, the packer is set, steam is injected into the well, the well cools, and the process of heating and cooling is repeated. The temperature recycling affects the packer causing it to relax. However, the high temperature destroys the elastomer seals and the reapplication of hydraulic fluid to the pistons fails to reset the packer and it must be retrieved.

The present invention is directed to a piston actuated high temperature well packer in which the piston seals as well as the other seals in the packer are constructed to withstand high temperature environments.

SUMMARY

The present invention is directed to the improvement of various seal means for allowing the packer to be used in high temperature environments in a well packer adapted to be set in a conduit for closing the bore. The packer includes a housing, a mandrel, an initially retracted packing seal, initially retracted slip means, hydraulically actuated means for expanding the packing seal, and hydraulic actuated means for expanding the slip means.

One feature of the present invention is wherein each of the hydraulic actuated means includes a metal piston movable in a hydraulic chamber and each of the pistons are ring-shaped with cup-shaped sealing surfaces extending from the pistons toward the hydraulic supply port through the packer mandrel whereby hydraulic fluid acts against and seals the sealing surfaces against the chamber.

Still a further object is the provision of spacing means positioned between the pistons for preventing the movement of the pistons towards the port thereby preventing damaging of the cup-shaped sealing surfaces. Preferably, the spacing means includes a circular ring connected to the mandrel for engaging the pistons.

Still a further object of the present invention is wherein the packer includes an abutment surrounding the mandrel and positioned adjacent the packing seal with a circular metal seal adjacent the abutment. Coacting wedge surfaces are provided on the metal seal and the abutment whereby when the seal and abutment are moved together, they will coact to provide a seal between the coacting wedge surfaces and will also wedge the seal inward for inward sealing.

Still a further object of the present invention is the provision of first and second abutments surrounding the mandrel and positioned adjacent one end of the packing seal with a circular metal seal ring positioned between the abutments. Coacting wedge surfaces are provided on the metal seal and each of the abutments whereby when the packing seal is set and the abutments are moved together they will coact with the metal seal to provide a seal between the coacting wedge surfaces and also wedge the metal seal inwardly for sealing.

Yet a still further object is the provision of a metal static seal between the housing and the mandrel in which the housing includes thread means for compressing the metal seal into a sealing relationship. A further static metal seal may be provided between the top abutment and the mandrel in which the abutment includes thread means for compressing the static metal seal into a sealing relationship between the top abutment and the mandrel.

Other and further objects, features and advantages will be apparent from the following description of a presently preferred embodiment of the invention, given for the purpose of disclosure and taken in conjunction with the accompanying drawings.

DESCRIPTION OF THE PREFERRED EMBODIMENT

Figure 1A:
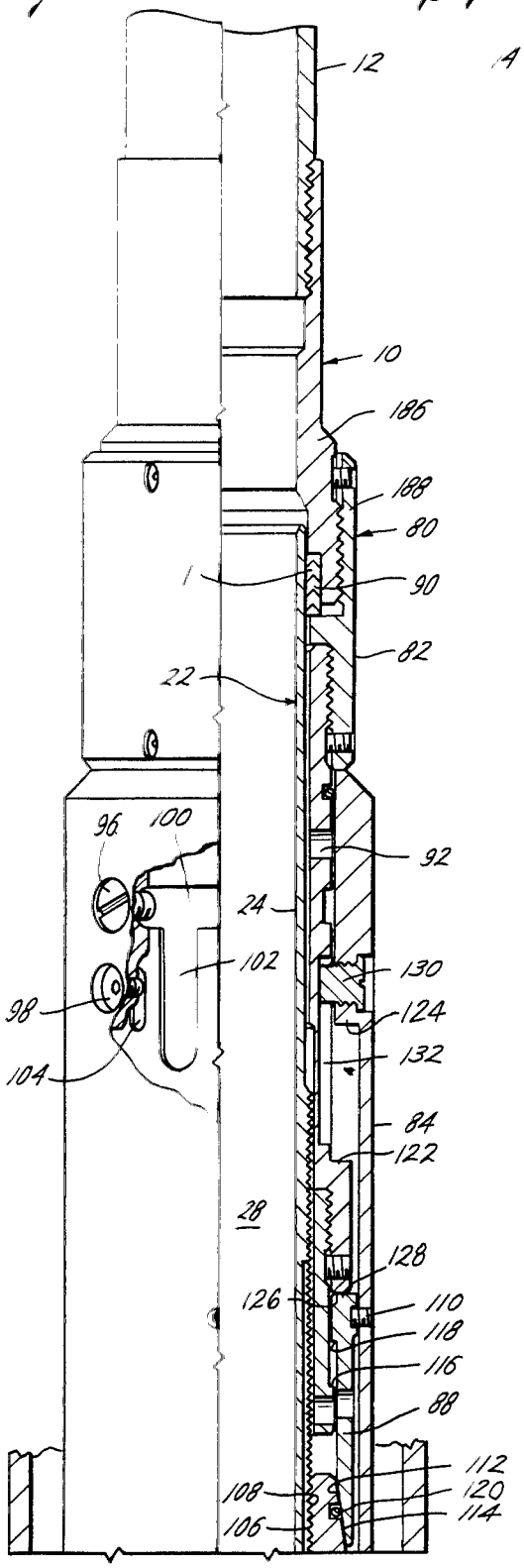
FIG. 1A is an elevational view, partly in cross section of the upper portion of a packer using the present invention with the parts in position as the packer is being lowered into the well bore.

While the present invention will be described as used in the hydraulic set well packer described in U.S. Pat. No. 3,603,388, issued Sept. 7, 1971, it is to be understood that the present invention may be utilized with any suitable hydraulically actuated well packer.

Referring now to the drawings, the packer of the present invention is generally indicated by the numeral 10, and is shown being lowered into position by a pipe or running in string 12 in a conduit such as a casing 14 in a well bore. In order to actuate the packer 10 by hydraulic fluid, a suitable plugging tool (not shown) is connected to the lower end of the packer 10 to block the bottom so that hydraulic pressure may be applied therein.

Figure 1B:
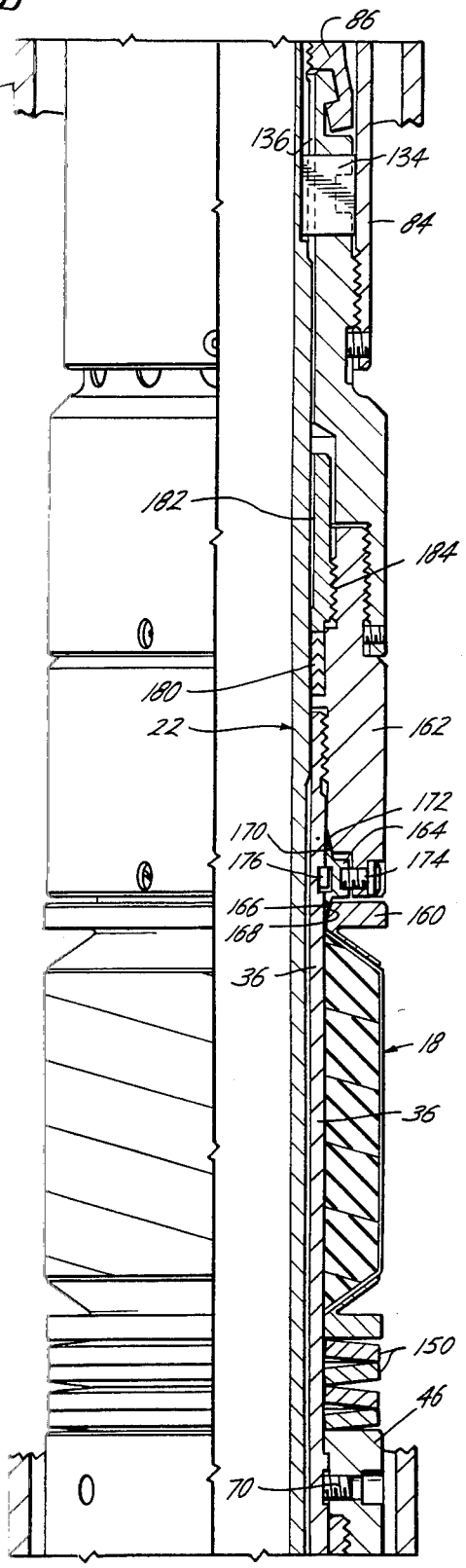
FIG. 1B is a continuation of FIG. 1A.
Figure 1C:
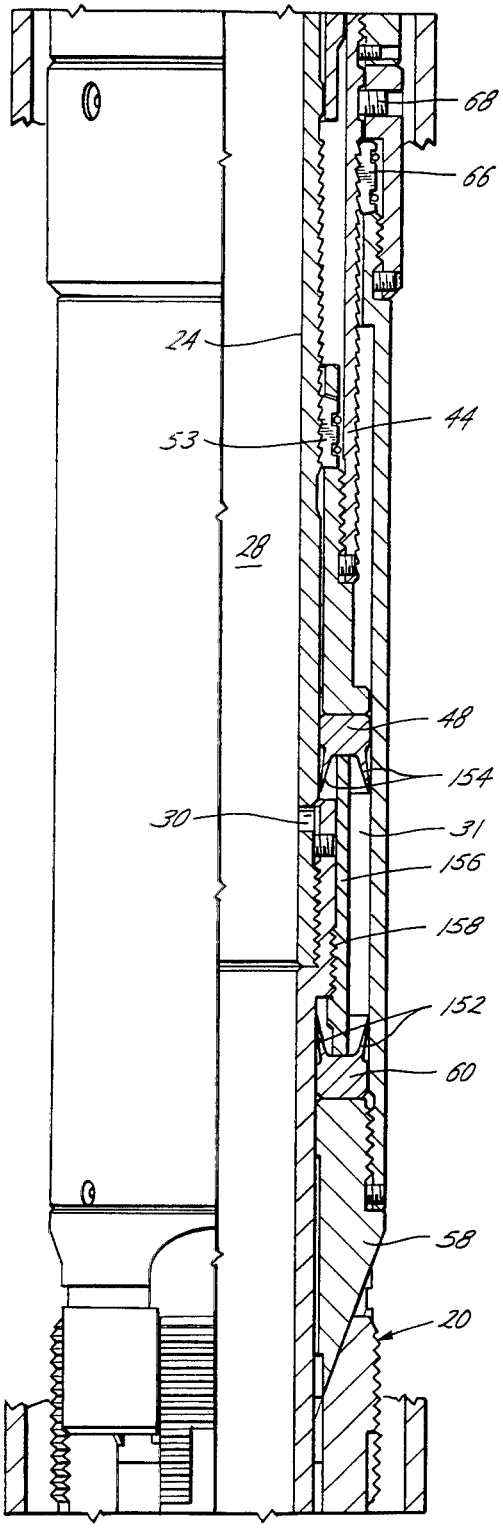
FIG. 1C is a continuation of FIG. 1B.
Figure 1D:
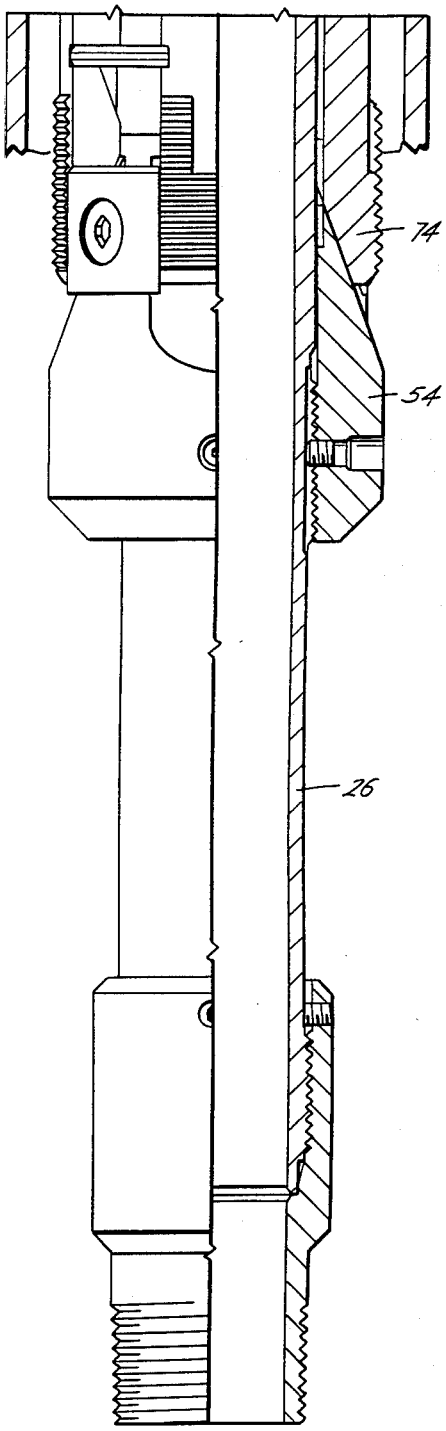
FIG. 1D is a continuation of FIG. 1C.

The packer 10 includes packer seal means generally indicated by the numeral 18 and a slip assembly generally indicated by the numeral 20, both of which are shown in their retracted positions in FIGS. 1B through 1D.

Referring now to FIGS. 1A through 1D, the packer 10 also includes a mandrel 22, which for convenience includes an upper portion 24 and a lower portion 26 secured together and an internal passageway 28 in communication with the running in string 12 for receiving hydraulic fluid to set the packer and includes at least one port 30 for passage of the hydraulic pressure for setting the slip assembly 20 and the packer seal means 18.

A lower slip cone 54 is provided secured to the mandrel portion 26 and positioned against the lower end of the slips 74 of the slip assembly 20. A hydraulically actuated slip-expanding means which includes slip-setting sleeve 56 is provided above the slip assembly 20 and includes an upper movable slip cone 58 and a piston 60 which is exposed to hydraulic pressure in a chamber 31 which communicates with port 30 for actuation of the piston 60 for expanding the slip assembly 20 outwardly and into engagement with the casing 14.

A hydraulically actuated packer seal expanding means includes packer seal setting sleeve 44, the upper end 46 of which is positioned adjacent the bottom of the seal means 18, and the lower end of which is provided with a piston 48. The piston 48 is exposed to hydraulic pressure in the chamber 31 for movement upwardly against the packer seal means 18 for setting the seal 18.

A one-way clutch 66 is provided between the sleeve 56 and the sleeve 44 allowing downward movement of the sleeve 56 when hydraulic pressure is applied to the piston 60 to allow the slip assembly 20 to expand outwardly and to allow the sleeve 44 to move upwardly relative to the sleeve 56 for preventing upward movement of the sleeve 56 relative to the sleeve 44 thereby locking the slip assembly 20 in its expanded position. A one-way clutch 53 is provided between the sleeve 44 and the mandrel 24 allowing movement upwardly of the sleeve 44 to expand the packer seal 18, but preventing downward movement of the sleeve 44 thereby locking the packer seal 18 into an expanded position when actuated.

Thus, with hydraulic pressure applied through the pipe 12 to the passageway 28, hydraulic fluid will flow through the port 30 and be applied against both of the opposing pistons 48 and 60. A first releasable holding means such as a shearpin 68 is provided connected between the slip-setting sleeve 56 and the seal-setting sleeve 44 to prevent actuation of the slip-setting sleeve 56 until a predetermined hydraulic setting pressure has been applied after the packer has been desirably positioned in the well conduit 14. A second releasable holding means or shearpin 70 is provided between the seal-setting sleeve 44 and the releasing sleeve 36 to prevent actuation of the sleeve 44 until a predetermined hydraulic pressure has been applied in the chamber 31. The shearpin 68 shears first allowing the slip-setting sleeve 56 to move downwardly carrying the upper slip cone 58 to expand the slip assembly 20 into setting engagement with the conduit 14. The shearpin 70 is then sheared allowing upward movement of the seal-setting sleeve 44 to compress and displace the seal means 18 and expand the packer seal means outwardly into a sealing relationship with the conduit 14.

Referring now to FIGS. 1A and 1B, the releasing assembly is generally indicated by the numeral 80 and generally includes a body 82, a housing 84, releasably engaging means 86 connected between the housing 84 and the mandrel 22 and releasable locking means 88 for locking and releasing the engaging means 86. Thus, the body 82 is adapted to be connected to the tubing string 12 and slidably and telescopically engages the mandrel 22 by seal 90 to normally seal off the interior 28 of the packer 10. The body 82 includes a bypass opening 92. A wiper 94 between the body 82 and the housing 84 prevents debris from entering the releasing mechanism.

The body 82 is, in its running in position, maintained in a fixed position relative to the housing 84 by a primary shearpin 96 and a secondary shearpin 98 as best seen in FIG. 1A. Thus the shearpin 96 is in one of the housing 84 and the body 82, here shown as in the housing 84, and extending into an annular groove 100 in the body 82 which is in communication with a longitudinal slot 102 which will be more fully described hereinafter. The secondary shearpin 98 is in a slot 104 and prevents relative rotational movement between the body 82 and the housing 84 and the pin 96 prevents longitudinal movement between the body 82 and the housing 84.

The lower end of the housing 84 abuts the upper end of the packer sealing means 18 through an abutment 162 and is initially prevented from longitudinal movement by the releasable engaging means 86 here shown as ratchets which are keyed to the housing 84 and have teeth 106 which coact with teeth 108 on the mandrel 22. Initially, a releasable locking means 88 such as a wedge-shaped ratchet lock is positioned, as best seen in FIG. 1B, between the back side of the ratchet 86 and the interior of the housing 84 to keep the ratchet teeth 106 in engagement with the teeth 108 on the mandrel 22. The releasable locking means or ratchet lock is releasably and initially connected to the housing 84 such as by a shearpin 110. The parts are initially positioned as shown in FIGS. 1A and 1B, causing the housing 84 to be rigidly locked to the mandrel 22, and thus the packer sealing means 18 may be compressed against the lower end of the housing 84 and abutment 162 and expanded into sealing position as previously indicated. The coacting taper surfaces 112 on the ratchet lock 88 and 114 on the ratchet 86, respectively, are selected so as to cause a slight upward force on the ratchet lock 88 due to a large upward force on the housing 84 relative to the mandrel 22 after the packer is set.

Coacting means between the body 82 and the releasing locking means 88 such as a coacting shoulder 116 on the body and the shoulder 118 on the ratchet lock 88 are provided for releasing the ratchet lock 88. Thus on upward movement of the body 82 relative to the housing 84 the coacting shoulder 116 will move into engagement with shoulder 118 for shearing the shearpin 110 and pulling the ratchet locks 88 from behind the ratchets 86 thereby allowing the ratchets 86 to become the disengaged from the mandrel 22 for releasing the packer.

When it is desired to release the packer from the casing 14 solely by a straight longitudinal pull, an upward pull is taken on the tubing string 12 causing the lower shoulder of the annular groove 100 to bear against and shear the pin 96. The body 82 then moves upward moving the seal 90 past the upper end of the mandrel 22 effecting pressure equalization from the passageway 28 to the tubing 14 through the passageway 92.

Further upward movement of the tubing 12 raises the body 82 longitudinally shearing the pin 110, pulling the ratchet locks 88 from behind the ratchets 86 thereby allowing the packing seal means 18 to retract and move the body 84 upwardly overcoming the garter spring 120 which normally keeps the teeth 106 on the ratchets 86 engaged with the teeth 108 on the mandrel 22 and move the ratchets 86 upwardly. Further upward movement of the body 82 relative to the housing 84 will cause engagement between coacting shoulders 122 on the body 82 and 124 on the housing 84 (FIG. 1A) to further move the housing 84 upwardly to allow the packer seal means 18 to further retract and to move the sleeve 36 upwardly for disengaging the slip assembly 20.

In addition, the releasing mechanism 80 can be released by a combination of rotational and longitudinal movement without requiring that shearpin 96 be sheared. Thus the tubing 12 and thus the body 82 may be rotated to shear the secondary shearpins 98 allowing the shearpins 96 to rotate in the annular groove 100. After pin 96 is aligned with the longitudinal slot 102, an upward pull is taken on the tubing 12 and the body 82. Since the longitudinal extent of slot 102 is greater than the distance required to retract the wedge locks 88 from behind the ratchet locks 86, shoulders 116 and 118 will move into engagement for shearing the shearpins 110 and pull the ratchet locks 88 from behind the ratchets 86 thereby releasing the packer, all without shearing the pin 96.

The ratchets 86 may be reengaged and locked by a downward movement of the body 82 which will bring coacting shoulder 126 on the body 82 and shoulder 128 on the ratchet locks 88 into engagement (FIG. 1A) to force the beveled end of the ratchet locks 88 again behind the ratchets 86 to again engage the threads 106 and 108 to allow a downward force to be exerted on the mandrel 22 and thus on equipment positioned below the packer 10.

The bypass passageway 92 (FIG. 1A) in the body 82 may be opened and closed without releasing the packer 10 for providing fluid flow between the casing 14 and the interior 28 of the packer. Thus, the tubing 12 and thus the body 82 may be rotated to shear the secondary shearpins 98 allowing the primary shearpin 96 to rotate in the annular groove 100. After pin 96 is aligned with the longitudinal slot 102, an upward pull is taken on the tubing 12 and body 82 to raise the seal 90 on the body 82 above the upper end of the mandrel 22 allowing fluid communication between the casing 14 and the interior 28 of the packer 10 through the passageway 92 while the body 82 is moved upwardly the shearpins 110 are not sheared and thus the packer is not released. Of course, the circulation valve passageway 92 may be omitted.

A locking key 130 and an elongated keyway 132 is positioned between the housing 84 and the body 82 and is shown as the key 103 being in the housing 84 and the keyway 132 being in the body 82. When the locking key 130 is positioned against one side of the slot 132 the primary shearpin 96 is aligned with the longitudinal slot 102 the locking key 130 acts as an indexing key. In addition, it is noted that the keyway 132 is elongated with respect to the locking key 130 and thus longitudinal upward movement of the body 82 for actuating the bypass valve 92 is provided. Also, after release of the packer, rotational movement may be transmitted from the tubing 12 through the body 82, keyway 132 and locking key 130 to the housing 84 and through a second key 134 and elongated keyway 136 to transmit torque to the mandrel 22 and thus to equipment positioned below the packer 10.

In use, the parts are shown in their running in position with the packer seal means 18 retracted and the slip assembly 20 retracted. In the releasing assembly 80, the ratchet locks 88 are positioned behind the ratchets 86 locking the housing 84 to the mandrel 22. The packer 10 is lowered to the desired setting location in the conduit 14 and pressure is applied down the tubing string 12 into the internal passageway 28 of the packer and through port 30 into the chamber 31 and applies a hydraulic force against the opposing packer seal-setting piston 48 and the slip-setting piston 60. Upon a predetermined hydraulic pressure, shearpin 68 shears allowing the slip-setting piston 60 to move downwardly moving the upper slip cone 58 toward the lower slip cone 54 and moving the slips 74 out into a gripping relationship with the interior wall of the conduit 14. Once the slip assembly 20 is set, further downward movement of the slip-setting assembly is prevented and the shearpin 70 shears allowing the packer seal setting piston 48 to move upwardly and the seal-setting sleeve 74 pushes the packer seal means 18 against the lower end of the housing 84 and abutment 162 which is fixed and locked to the mandrel 22 through the ratchets 86 to set the packer seal 18 into a sealing relationship with the conduit 14.

For a fuller description of the structure and operation, refer to U.S. Pat. No. 3,603,388, which is incorporated herein by reference.

Generally, the above description and operation of a hydraulically actuated piston type well packer is shown in Patent No. 3,603,388. However, that patent discloses the use of various elastomer type seals to form the pistons and to seal the various parts of the packer for preventing flow therethrough. However, such a packer will not withstand the high temperatures involved in steam flooding a well or other environmental conditions in which high temperatures, such as 1200° F., may be encountered.

Therefore, the present well packer 10 is provided with various types of improved seals to withstand high temperature environments. First, the packer seal means 18 is made of a substance to withstand high temperatures, such as asbestos. In addition, a plurality of springs, such as Belville springs 150 are provided between one end of the packer seal means 18 and the upper end 46 of the packer seal setting sleeve 44. The springs 150 aid in holding the asbestos seal in an expanded position when the packer is set.

Referring to FIG. 1C, the piston 60 for expanding the slip assembly 20 and the piston 48 for setting the packer seal means 18 are circular metal piston and seals which are ring-shaped with cup-shaped sealing surfaces 152 and 154, respectively, which extend from the pistons 60 and 48, towards the port means 30. The metal pistons 60 and 48 are movable in the hydraulic chamber 31 and the incoming hydraulic fluid from the port 30 into the chamber 31 acts against the inside of the cup-shaped sealing surfaces 152 and 154 to urge them outwardly into a sealing engagement with the interior of the hydraulic chamber 31. The piston 60 acts against the cone member 58 and moves the sleeve 52. The piston 48 acts against the packer seal setting sleeve 44.

However, it is desirable that the movable pistons 60 and 48 not move towards the port 30 as they would encounter various shoulders in the chamber 31 and possibly damage the thin edges of the cup-shaped sealing surfaces 152 and 154. In order to prevent such damage and possibly loss of a seal, a spacing means 156 is provided positioned between the pistons 60 and 48 which engages the backside of and prevents the movement of the piston 60 and 48 inwardly towards the hydraulic port 30. Preferably the spacing means 156 is a circular ring connected to the mandrel 22 such as by threads 158. Thus, even if the piston 60 moves away to set the slip assembly 20, the spacing means 156 will remain intact to hold and protect the cup-shaped sealing surfaces 154 of the piston 48.

Referring now to FIG. 1B, the packer seal means 18 includes a circular abutment 160 at one end such as the top end. In addition, a second abutment 162 is provided connected to the releasing sleeve 36 and to the housing 84 surrounding the mandrel 22. A metal ring seal 164 is provided positioned between the abutments 160 and 162. First and second coacting wedge surfaces 166 and 168 are provided between the metal seal 164 and the abutment 160, respectively. In addition, coacting wedge surfaces 170 and 172 are provided between the abutment 162 and the metal ring 164, respectively. When the packer is set the abutments 160 and 162 are driven towards each other. The coacting wedge surfaces 166 and 168 will be moved together to form first a seal between the abutment 160 and the ring metal seal 164 which also pushes the lower lip of the seal 164 inwardly against the releasing sleeve 36. This action seals any possible leakage through the packer between the releasing sleeve and the packer element 18.

Similarly, the coacting wedge surfaces 170 and 172 when moved together provide a seal between the ring 64 and the abutment 162 and the upper lip is similarly driven inwardly against the releasing sleeve 36 to provide a seal therewith. Therefore, any possible leakage upwardly between the mandrel 22 and the releasing sleeve 36 and outwardly between the abutments is prevented. The metal seal ring 164 is secured in place with a slop fit first to the abutment 162 by a screw 174 and to the releasing sleeve 36 by a clamping ring 176.

Referring still to FIG. 1B, a static metal seal 180 is provided between the top abutment 162 and the mandrel 22 for preventing fluid leakage therebetween. However, in order to obtain a satisfactory seal between the abutment 162 and the mandrel 22, the abutment includes a threaded stem 182 which can be threaded relative to the abutment 162 by means of coacting threads 184 to compress the static seal 180 to provide the desired sealing action.

Referring to FIG. 1A, the seal 90 is also a static metal seal which is set by compression between the threaded members 186 and 188 which form the body 80.

Thus, all of the seals 90, 164, 180, and the seals on the pistons 60 and 48 are able to withstand high temperatures. Therefore, in the event that in cycling high and low temperatures through the packer 10, the sealing packer element 18 relaxes, all of the seals will still be usable and the packer 10 may be repressured by hydraulic fluid and reset.

The present invention is therefore well adapted to carry out the objects and attain the ends and advantages mentioned as well as others inherent therein. While a preferred embodiment of the invention has been given for the purpose of disclosure, numerous changes in the details of construction and arrangement of parts will readily suggest themselves to those skilled in the art and which are encompassed within the spirit of the invention and the scope of the appended claims.

What is claimed is:

1. In a well packer adapted to set in a conduit for closing a well bore, having a housing and a mandrel, an initially retracted packer seal means surrounding said mandrel, initially retracted slip means surrounding said mandrel, hydraulic actuated means for expanding the packing seal, hydraulic actuated means for expanding the slip means, port means through the mandrel for supplying hydraulic fluid to both hydraulic actuated means, the improvement in seal means for allowing the packer to be used in high temperature environments comprising, each of said hydraulic actuated means including a metal piston movable in a hydraulic chamber, each of said pistons being ring shaped with cup-shaped sealing surfaces extending from the piston towards said port means for sealing against the chamber by the hydraulic fluid, first and second abutments surrounding the mandrel and positioned adjacent one end of the packing seal, a metal seal ring between the abutments, coacting wedge surfaces on the metal seal and each of the abutments positioned inside of the abutments whereby when the packer seal is set and the abutments are moved together they will coact with the metal seal to provide a seal between the coacting wedge surfaces and also wedge the metal seal inwardly for sealing, a metal static seal between the housing and said mandrel, said housing including thread means for compressing said metal static seal.

2. The apparatus of claim 1 including, a second metal static seal between the top abutment and the mandrel, and said top abutment includes thread means for compressing said second static metal seal.

3. The apparatus of claim 2 including, spacing means positioned between the pistons for preventing the movement of the pistons towards the port.

* * * * *